US007640973B2

(12) United States Patent
Keith

(10) Patent No.: US 7,640,973 B2
(45) Date of Patent: Jan. 5, 2010

(54) DEVICE FOR DIVERSION OF CAVITATION FLOWBACK

(75) Inventor: James P. Keith, Farmington, NM (US)

(73) Assignee: Antelope Sales & Service, Inc., Farmington, NM (US)

( * ) Notice: Subject to any disclaimer, the term of this patent is extended or adjusted under 35 U.S.C. 154(b) by 0 days.

(21) Appl. No.: 11/732,154

(22) Filed: Apr. 2, 2007

(65) Prior Publication Data

US 2007/0227723 A1 Oct. 4, 2007

Related U.S. Application Data

(60) Provisional application No. 60/788,460, filed on Mar. 31, 2006.

(51) Int. Cl.
*B05B 1/26* (2006.01)

(52) U.S. Cl. ..... 166/75.11; 166/308.1; 366/336; 366/339; 137/808

(58) Field of Classification Search ..... 166/75.11, 166/308.1; 175/206, 207, 208, 209, 212, 175/218; 366/336, 339; 137/808
See application file for complete search history.

(56) References Cited

U.S. PATENT DOCUMENTS 4,224,985 A * 9/1980 Rapson ..... 166/57

* cited by examiner

*Primary Examiner*—Shane Bomar
*Assistant Examiner*—Brad Harcourt
(74) *Attorney, Agent, or Firm*—Kenton L. Freudenberg

(57) ABSTRACT

A diverter for containing and reducing the velocity of the particulate discharge from a well bore being subjected to the process of "cavitation." The diverter has a generally conical hollow containment shell and an internal diverter assembly with replaceable wear parts wherein the flow is directed into a spiral path along the inner surface of the containment shell. The path of flow is such that the flow velocity is dissipated without impeding or obstructing the flow of particulates. Water can be injected into the flow to help prevent fine particulates from becoming airborne.

10 Claims, 4 Drawing Sheets

DEVICE FOR DIVERSION OF CAVITATION FLOWBACK

PRIOR APPLICATIONS

This application is a based upon applicant's provisional patent application, 60/788,460 filed Mar. 31, 2006 which is hereby incorporated herein by reference.

BACKGROUND OF THE INVENTION

The present invention provides for diverting, containing and reducing the velocity of the discharge from a well bore being subjected to the process of "cavitation" as used to enhance production of coalbed methane.

SUMMARY OF THE INVENTION

Modern exploitation of fossil fuel energy resources has found an increasing source of natural gas in the extraction of coal bed methane, a byproduct of the coal formation process. Such methane can be recovered from coalbed deposits that are too deep to mine. A commonly used technique to enhance the recovery of methane from an underground coalbed deposit is known as "cavitation." To extract the methane, a well is drilled into the coal seam. A tubing string is run into the well bore hole and air, carbon dioxide or other suitable gas is pumped into the well to pressurize the well to a desired elevated pressure (e.g. 1500 to 2000 psi). The pressure is then quickly released causing the coal to fail and fragment into particles, most of which are discharged from the well through the release of the high-pressure gas, a discharge which can last, for example, 20 minutes. The removal of coal particles forms a cavity in the seam and further fractures the coal to facilitate flow of methane. The above steps may be repeated until the desired cavitation and fracturing is achieved.

The procedure of cavitation as described above results in a release of the compressed gas, coal fines and other solids from the well at high-pressure and high velocity. If not controlled and/or directed, this discharge, or "flowback" can be a substantial safety hazard, create substantial quantities of airborne particulates, and contamination of the well site and/or surrounding area with settled particulates, mud, produced water and other such contaminants. However for the cavitation procedure to be effective, it is not desirable to restrict the discharge flow. Prior methods of containing flowback which have proven less than ideal include directing the flowback stream at an earthen berm or directing the stream through a baffled pipe. The former method is largely ineffective at preventing airborne particulates and the latter can be complicated by the discharge by becoming blocked or clogged by the solid material in the flowback.

The present invention provides a diverter to dissipate the energy of the "flowback" to allow for controlling and directing the materials, reducing airborne dust and contamination of the well site and surrounding area and, reduce or redirecting the noise generated by the flowback discharge. These goals are achieved using a structure which is self cleaning, thereby insuring the effectiveness of the cavitation process by minimizing any restriction or limitation of the volume of the discharge flow.

The flowback diversion device of the present invention uses a large conical containment shell with the flowback entering through an inlet of approximately 6 inches in diameter at the smaller end of the cone. The conical shape of the housing accommodates normal expansion of the flow back discharge as its pressure and velocity decrease. The flow back stream is directed against a centrally mounted replaceable diverter cone and diverter assembly which directs the flow generally radially outward toward the inner wall of the conical containment shell. The flow is further directed into a generally spiral path along the inner wall of the containment shell by a set of stationary helical "vanes." While the flowback is deflected and directed into a non-straight path, that path is generally continuous, open and unobstructed. The velocity of the flow is dissipated as the flow impinges upon and is deflected by the diverter elements and turbulence created by the flow interacting with itself. The energy of the flow is dissipated as its velocity is decreased, its volume expands within the containment shell and its pressure is decreased. The conical shape of the containment shell helps insure that there are no areas in the flow path in which particulates may settle or become "packed-off"creating a blockage or impediment to the flow. This self-cleaning effect increases the effectiveness of the cavitation process and reduces the possibility of a potentially dangerous sudden buildup of pressure in the lines or fittings feeding the diverter and any catastrophic failure which might result.

In order to further facilitate removal of fine particulates from the flowback as its velocity is reduced, the containment shell may be fitted with numerous nozzles capable of supplying a water curtain to capture and settle out such particulates and prevent them from becoming airborne. The reliability and efficiency of the device is enhanced by having no moving parts and providing for simple replacement of parts which are most subject to wear.

It is an object of the present invention to provide a diverter to allow flowback from a cavitation process to be controlled and contained.

It is an object of the present invention to provide a flowback diverter which reduces or redirects the sound generated by high pressure flowback.

It is an object of the present invention to provide a flowback diverter can dissipate the velocity of a flowback stream of which has a flowback path which is essentially unobstructed.

It is an object of the present invention to provide a flowback diverter having no moving parts.

It is an object of the present invention to provide a flowback diverter in which parts which are most subject to wear are easily replaceable.

It is a further object of the present invention to provide a flowback diverter which is self cleaning and not subject to becoming blocked or clogged by flowback debris.

It is another object of the present invention to provide a flowback diverter which reduces or prevents flowback particulates from becoming airborne.

DETAILED DESCRIPTION OF THE INVENTION

Figure 1:
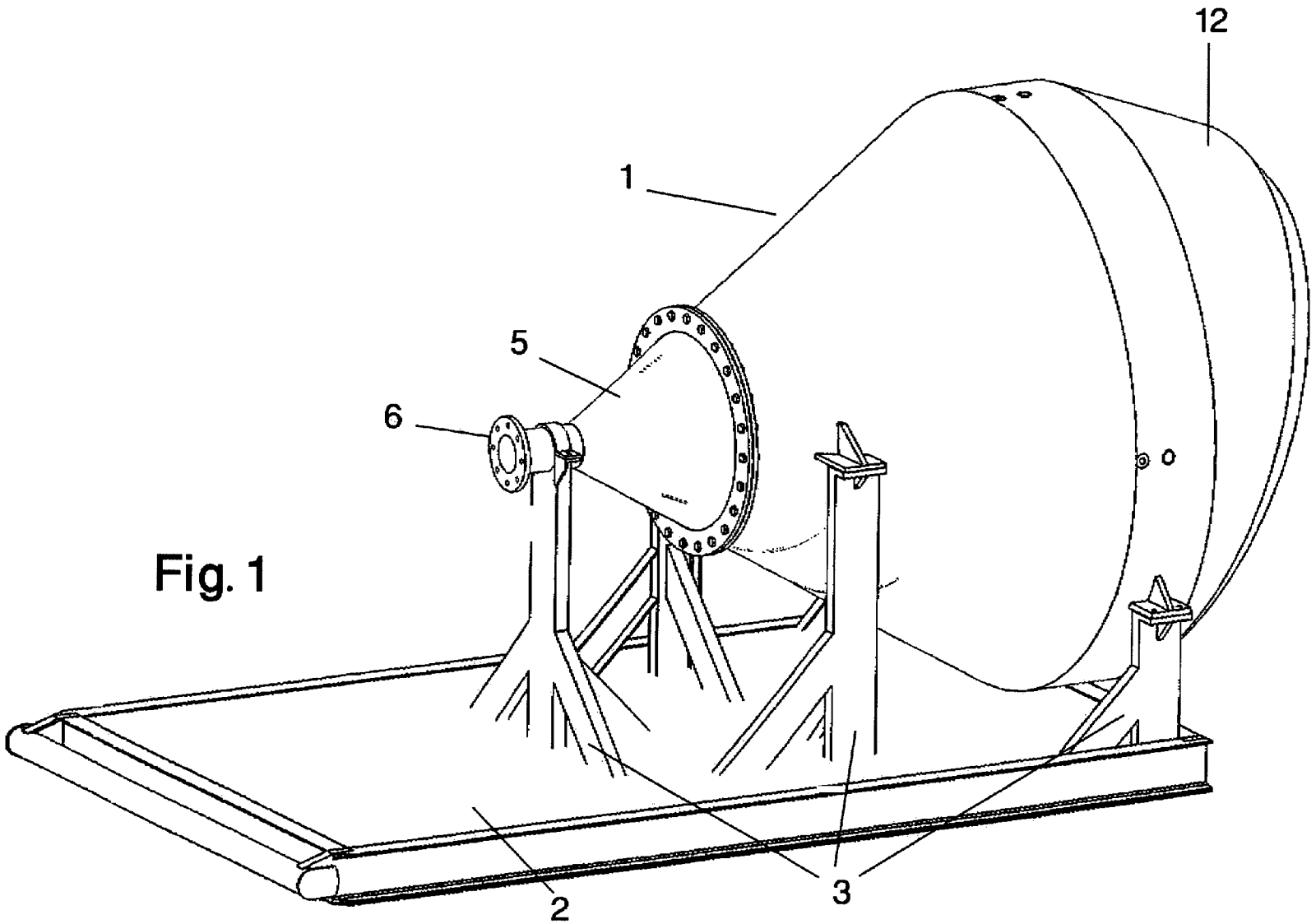
FIG. 1 is a perspective view of the device of the preferred embodiment showing the FIG. 2 is a cutaway view corresponding to FIG. 1 in a vertical plane through the axis of the conical housing showing the arrangements of the internal diverter or components.
Figure 2:
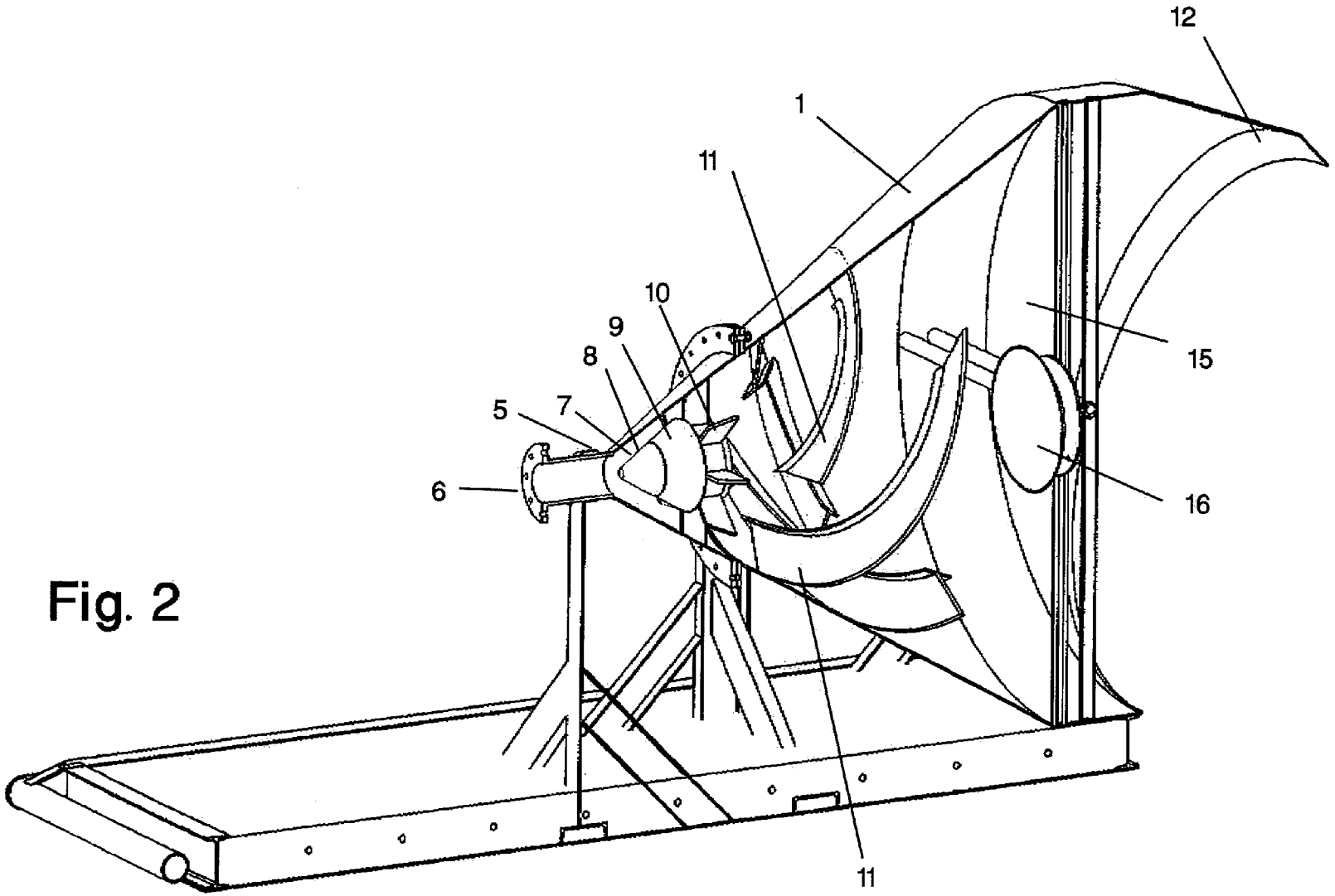
Figure 3:
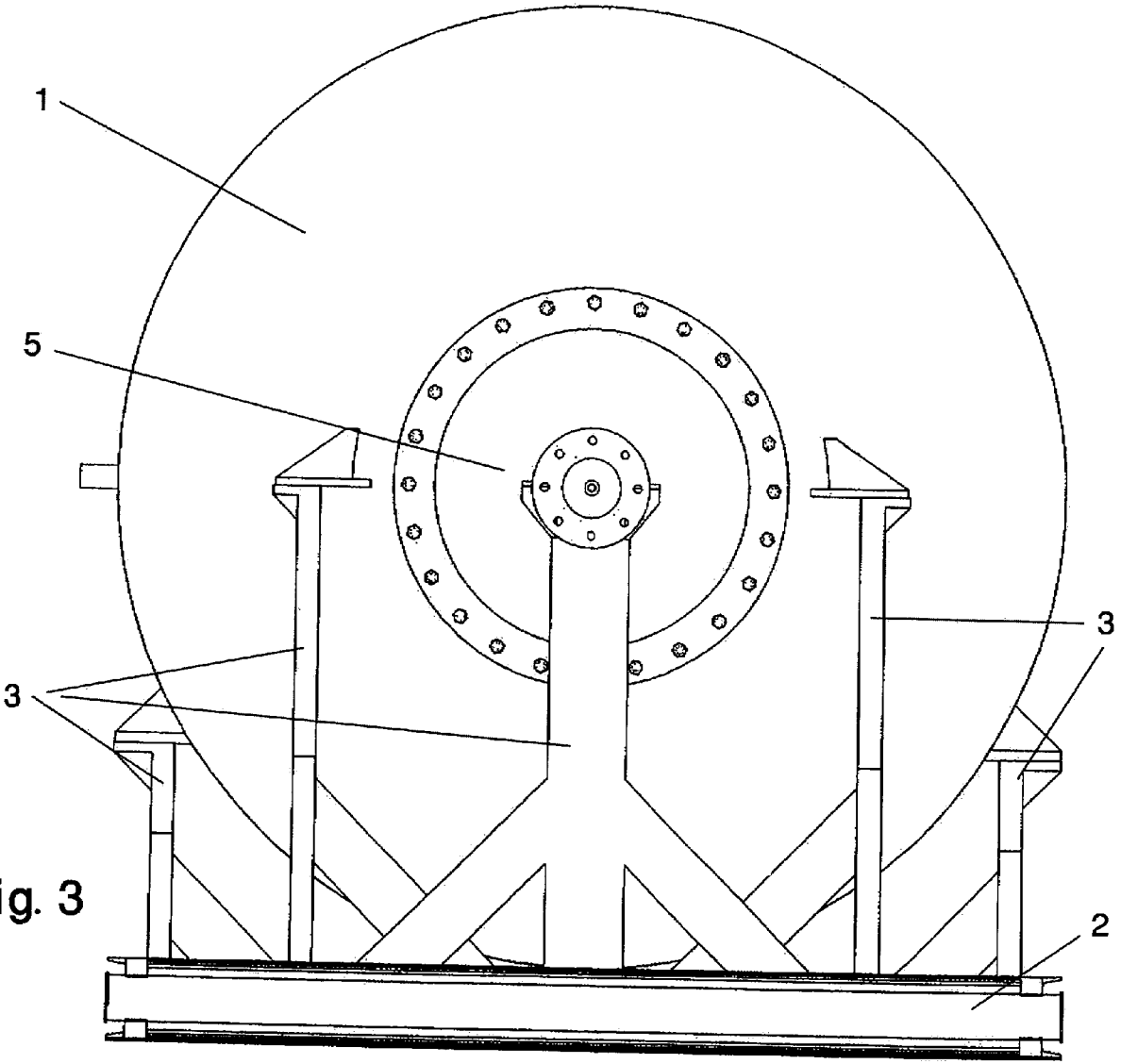
FIG. 3 is a plan view from the inlet end of the device of the preferred embodiment.
Figure 4:
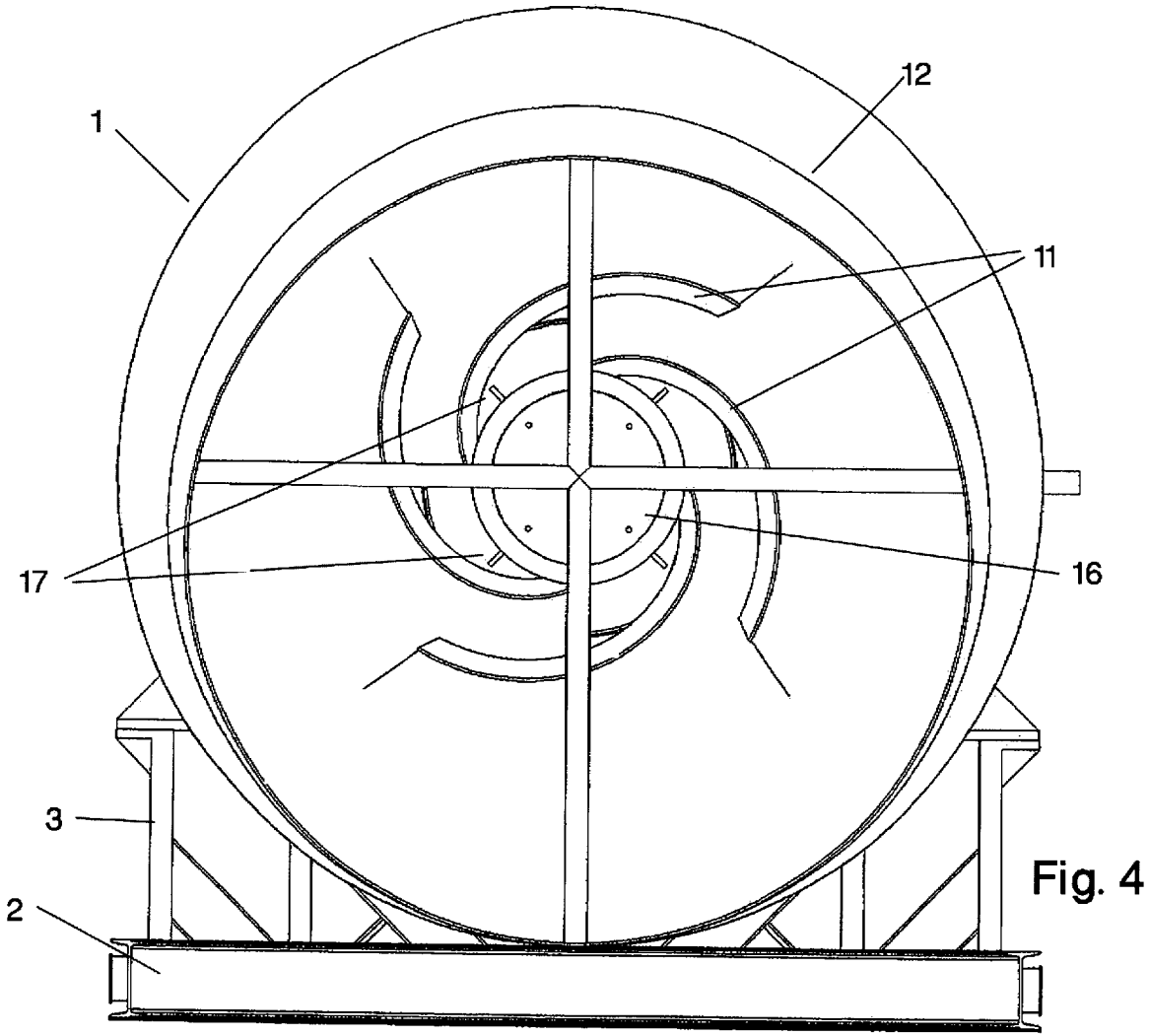
FIG. 4 is a plan view from the outlet end of the device of the preferred embodiment.

As shown in FIG. 1 the hollow conical containment shell 1 of the preferred embodiment is a heavy steel structure mounted on a base comprising a steel skid 2 approximately 8 feet wide and 14 feet long filled with concrete. Such a skid provides sufficient mass to resist the substantial reactive forces incurred during operation of the device without requiring the device to be permanently fixed at an operating site and allows transport of the device using normal heavy equipment. The shell is supported above and attached to the skid by suitable steel framing members 3. Flowback from a well is fed to the inlet portion 5 of the device through piping, typically steel pipe of six inch diameter, attached to inlet portion 5 using a normal flanged pipe fitting 6. The flow enters the smaller inlet end of the containment shell along the axis of the conical end shell and is directed against a conical diverter assembly 7 comprised of a solid faced central nose piece 8 mounted within and extending beyond a generally frustum shaped housing 9. The nose piece 8 is directly in line with the high-energy flow back discharge and is subject to the highest impact and abrasion from the various particulates contained within the flow. Is accordingly desirable to provide for simple removal and replacement of the nose piece as it may wear away or become damaged. The diverter housing is further provided with guides 10 in the form of fin-like planar structures, each generally parallel to or within an axial plane (a plane passing through the axes of the containment shell the conical diverter or both), on the outer surface of the frustum to further align, direct and evenly distribute the flow toward the inner circumference of the conical containment housing.

Spiral or helical vanes 11 are mounted to the inside surface of the containment shell to further direct the flow into a spiral path along the inner surface of the containment shell and create additional turbulence to further dissipate the energy of the flow without blocking or impeding the flow. The velocity of the flow thereby decreases as the flow reaches the large discharge opening 15 of the containment shell where the flow can be discharged and captured in earthen pit or similar structure. The discharge opening 15 is further provided with an angled extended lip or collar 12 to further facilitate directing the flow downward into such a pit.

In order to minimize the likelihood of extremely fine particulates from the flowback becoming airborne, the discharge opening is further provided with a central plate 16 mounted with numerous nozzles 17 capable of providing a flow of water or other fluid radially outward in a pattern which creates a "curtain" covering essentially the entire plane of the discharge opening, or an entire cross-sectional planar portion of the path of the flowback. The particulates are thereby settled out and captured creating a slurry-like mixture which simply drains into the capture pit.

What is claimed is:

1. A device for diversion of cavitation flowback from an underground well, comprising a tubular inlet portion, a conical containment shell having a small end and a large end, an inlet opening at a said small end of said conical shell and a discharge opening at said larger end, a conical diverter assembly having a small end and a large end and being centrally disposed within and generally coaxial with said containment shell, said conical diverter assembly further comprising a replaceable nose piece axially mounted on said small end of said diverter assembly, wherein said flowback is directed into the inlet opening of the containment shell along the central axis of the containment shell and against the small end of said conical diverter assembly, said flowback being thereby redirected toward an inner surface of said containment shell, said flowback generally following a path along said inner surface toward the larger end of the containment shell, said flowback exiting the containment shell through said discharge opening, wherein the path of said flowback between said inlet opening and said discharge opening is essentially unobstructed.

2. A device for diversion of cavitation flowback according to claim 1, wherein said conical diverter assembly comprises planar guides externally mounted on said diverter assembly to further direct the flowback.

3. A device for diversion of cavitation flowback according to claim 2, wherein each said planar guide is generally parallel to or within an axial plane of said the diverter cone.

4. A device for diversion of cavitation flowback according to claim 1, wherein said conical containment shell comprises spiral guides mounted on the inner surface of the conical containment housing, said spiral guides further directing direct the flowback into a spiral path along the inner surface of said containment shell.

5. A device for diversion of cavitation flowback according to claim 1, wherein said conical containment shell comprises an extension of said shell, said extension being located above said discharge opening, said extension being configured to direct the flowback downwardly as it exite the discharge opening.

6. A device for diversion of cavitation flowback according to claim 1, wherein said conical containment shell comprises a plurality of nozzles, said nozzles being arranged to provide a flow of liquid in generally planar pattern, said planar pattern being generally perpendicular to the direction of travel of said flowback and encompassing the entire cross-section of said flowback.

7. A device for diversion of cavitation flowback according to claim 6, wherein said conical containment shell comprises a plate centrally disposed near said discharge opening, said plate further comprising a plurality of nozzles each said nozzle providing a flow of liquid radially outward with respect to the axis of said shell.

8. A device for diversion of cavitation flowback according to claim 1, wherein said device is mounted on a transport skid, said skid having suffcient mass to provide stability to resist the reactive forces resulting from the discharge of the flowback during use of the device.

9. A device for diversion of a cavitation flowback stream from an underground well, comprising a tubular inlet portion, a conical containment shell having a small end and a large end, an inlet opening at a said small end of said conical shell and a discharge opening at said larger end, said conical containment shell allowing expansion of the volume of flowback and a reduction in velocity of said stream within said shell and , wherein the path of said flowback stream between said inlet opening and said discharge opening is essentially open and unobstructed.

10. A device for diversion of a cavitation flowback stream according to claim 9 further comprising means within said conical containment shell for creating turbulence within said flowback stream to dissipate the energy of said stream.

* * * * *